United States Patent [19]

Müller

[11] Patent Number: 4,547,759

[45] Date of Patent: Oct. 15, 1985

[54] COIL FORM

[75] Inventor: Erwin Müller, Munich, Fed. Rep. of Germany

[73] Assignee: Siemens Aktiengesellschaft, Berlin and Munich, Fed. Rep. of Germany

[21] Appl. No.: 603,466

[22] Filed: Apr. 24, 1984

[30] Foreign Application Priority Data

May 5, 1983 [DE] Fed. Rep. of Germany ..... 3316456

[51] Int. Cl.[4] ..... H01F 15/10

[52] U.S. Cl. ..... 336/192

[58] Field of Search ..... 310/71, 194; 336/192, 336/198, 208

[56] References Cited

U.S. PATENT DOCUMENTS

| | | | |
|---|---|---|---|
| 2,999,962 | 9/1961 | Wahl | 336/192 X |
| 3,445,797 | 5/1969 | Otto | 336/192 |
| 3,566,322 | 2/1971 | Horbach | 336/192 |
| 3,928,831 | 12/1975 | Yatsushiro et al. | 335/262 |
| 3,979,707 | 9/1976 | Prince, Jr. | 336/192 X |
| 4,423,399 | 12/1983 | Goodrich | 336/192 X |

FOREIGN PATENT DOCUMENTS

| | | | |
|---|---|---|---|
| 286849 | 12/1962 | Netherlands | 336/192 |

*Primary Examiner*—Thomas J. Kozma
*Attorney, Agent, or Firm*—Thomas H. Jackson

[57] ABSTRACT

The coil form has auxiliary points of support for the winding ends in the form of two retaining lugs each, which enclose between them a breakthrough in the coil form. After the coil is wound, a metallic connecting element can be inserted into this breakthrough so that its free end is positioned between the retaining lugs and can be soldered to the winding ends already applied to the retaining lugs.

6 Claims, 5 Drawing Figures

COIL FORM

BACKGROUND OF THE INVENTION

The invention relates to a coil form of insulating material with breakthroughs provided in a flange part for the plug-in fastening of metallic connection elements for winding ends.

Coils for relays and other switchgear are usually wound by automatic machines and then assembled as a whole in the appropriate equipment. If connecting pins were already fastened in the coil form prior to the winding operation by molding or insertion, the winding ends can be wound by the automatic winding machine directly on the connection pins and soldered to them in a subsequent operation. However, it is usually not possible, due to production engineering limitations to attach the coil connection elements to the coil form prior to the winding operation; such as when sheet metal connecting elements of a larger size are involved. In this case, an auxiliary point of support, which may either be molded onto the insulating material of the coil form or be anchored in it in the form of a wire, is required for the mechanized winding on of the coil ends. In most of these cases excessive labor costs are required for the subsequent operation of connecting the winding ends of the connection wires carrying them to inserted sheet metal connecting parts.

SUMMARY OF THE INVENTION

It is an object of the invention to provide a coil form on which the winding ends can automatically be wound onto auxiliary points of support in a simple manner, and then can be connected to subsequently inserted metallic connection elements by a simple soldering operation.

According to the invention, this object is achieved with a coil form of the aforementioned type. Retaining lugs are molded onto at least two opposite edge areas of the breakthroughs of the coil form. Each lug is at least as wide as the part of a connecting element which can be struck between them through the breakthrough.

Accordingly, each two retaining lugs, including between them one breakthrough for a connection element, jointly form one winding support point on which a winding end can be wound so that a connecting element can still be inserted subsequently between the retaining lugs or into the winding end loop and be soldered to the winding end. It is expedient for the retaining lugs either to have a shoulder towards their free end or to be placed jointly on a recessed surface of the coil form. This insures that the soldering iron has good access to the winding end. The free end of the connecting element is expediently twisted between the two retaining lugs. In this case, the width of the retaining lugs should correspond to the twisted and transversely oriented end of the connecting element. But the connecting element may also be fixed to the coil form by means of a bent tab.

Other features and advantages of the present invention will become apparent from the following detailed description, and from the claims.

For a full understanding of the present invention, reference should now be made to the following detailed description and to the accompanying drawings.

DETAILED DESCRIPTION

Figure 1:
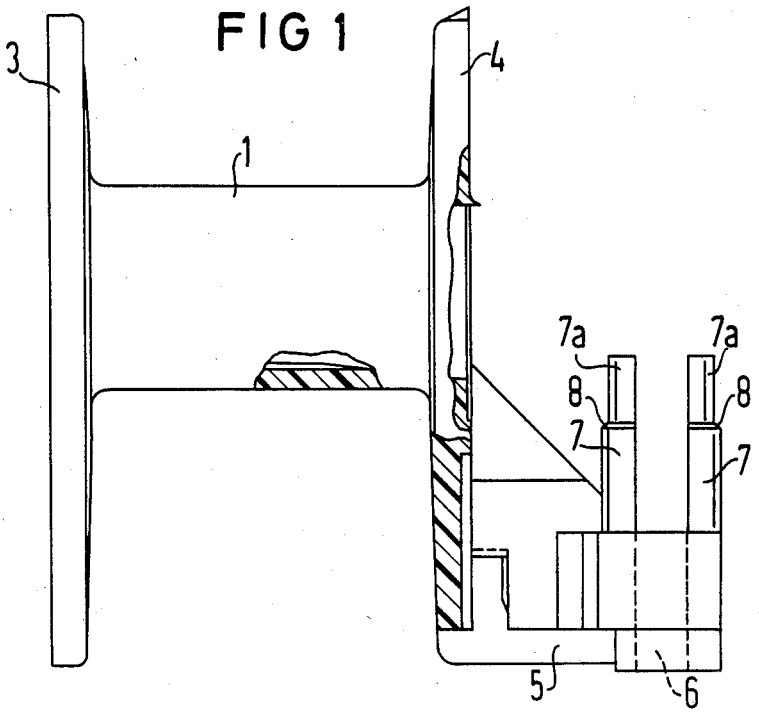
FIG. 1 shows a side view of a coil form according to the invention.
Figure 2:
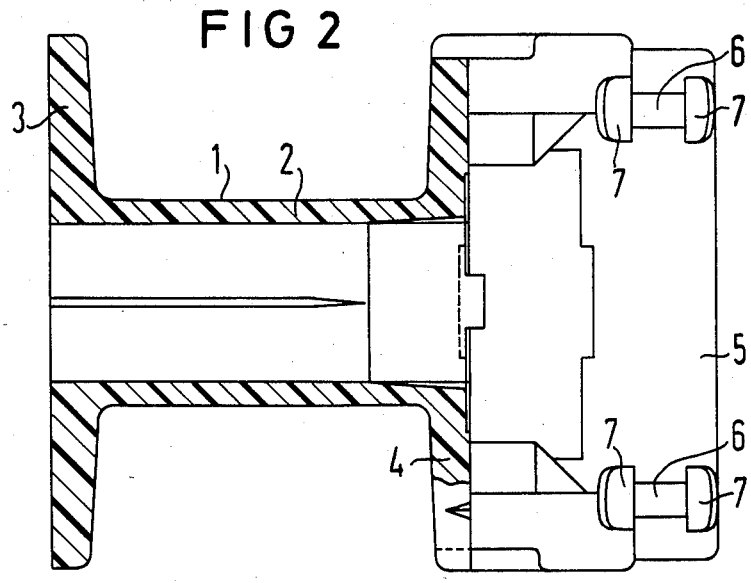
FIG. 2 shows a top view of the coil form according to the invention.

Coil form 1, shown in FIGS. 1 and 2, has coil tube 2 to receive a winding and two flanges 3 and 4. Molded to coil flange 4 is extension 5 which has breakthroughs 6 to receive sheet metal connecting elements (not shown). Molded on both sides of each breakthrough 6 are retaining lugs 7. Each lug is wider than breakthrough 6 so that a winding end wound over both retaining lugs 7 does not interfere with the insertion of a connection element. Each retaining pin has shoulder 8 so that the winding end wound on free end 7*a* cannot slip down, and therefore it remains very accessible for soldering.

Figure 3:
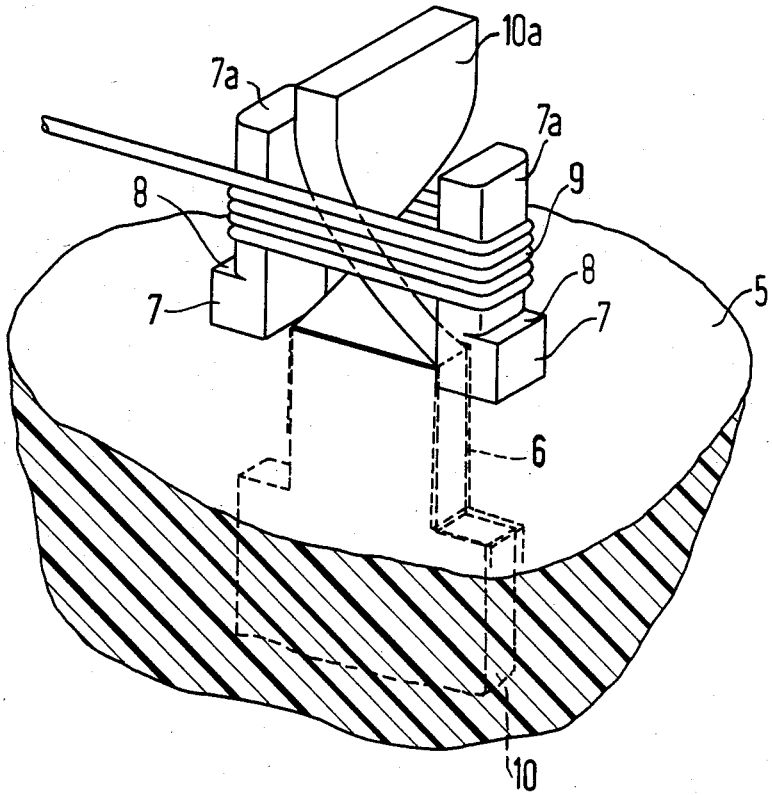
FIGS. 3 to 5 show perspective views of different embodiments of the invention.

FIG. 3 shows a perspective view of details of the coil form shown in FIGS. 1 and 2. Retaining lugs 7 disposed on coil form extension 5 already support a wound-on winding end 9; several turns having been wound on reduced ends 7*a* of retaining lugs 7.

After the coil is wound, a connecting element 10 is inserted into breakthrough 6 so that its free end 10 *a* is located between retaining lugs 7. This free end 10*a* is twisted to fix the connecting element. The electrical connection is established subsequently between winding end 9 and connection element 10 simply by soldering.

Figure 4:
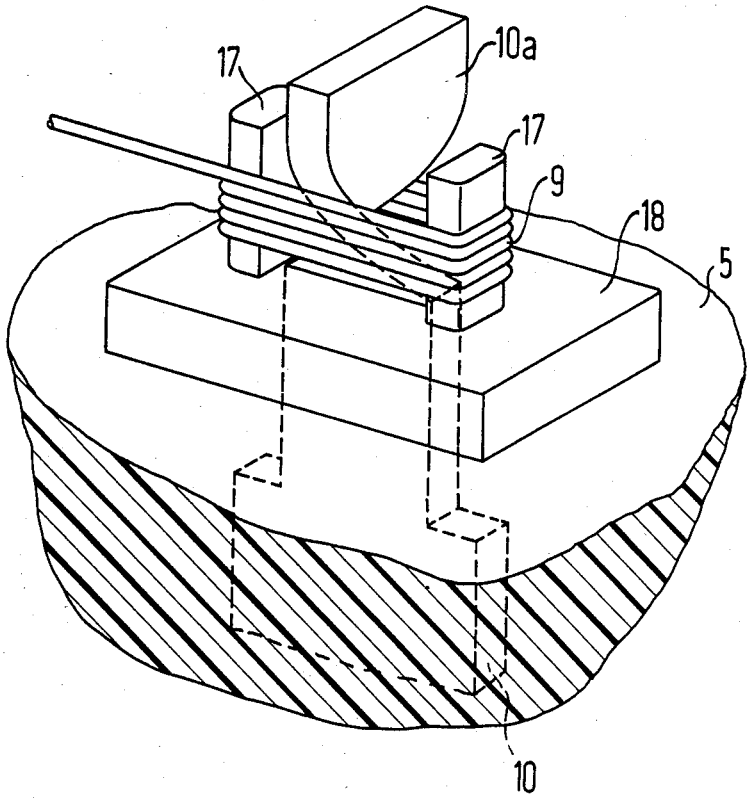

An alternate embodiment is shown in FIG. 4. There, two retaining lugs 17 are disposed on raised surface 18 of coil form extension 5 to prevent slipping of winding end 9 in this case also. Connecting element 10 is inserted and twisted the same way as before for FIG. 3.

Figure 5:
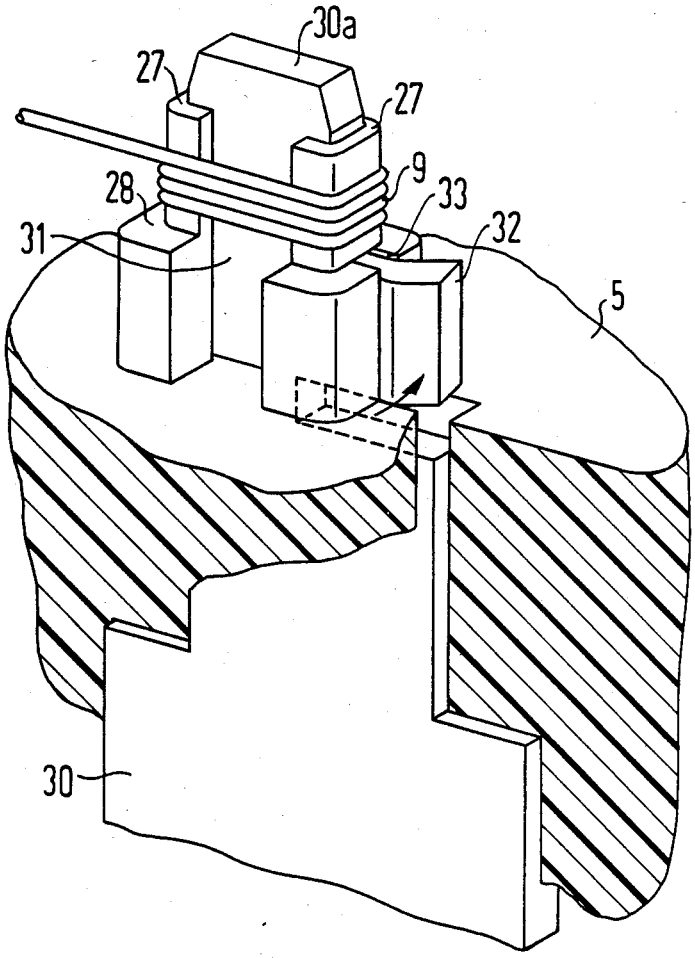

Another embodiment is shown in FIG. 5 where each of the two retaining lugs 27 are shaped so that they enclose in a U-shape the connecting element 30 which is inserted between them. This connecting element 30 is then soldered to winding end 9 in slot 31 provided on both sides. Again, a shoulder 28 prevents the winding end from slipping down. In this embodiment lateral tab 32 is provided to fix retaining element 30. Lateral tab 32 of connection element 30 is located in lateral slot 33 of retaining lug 27 and the connection element is fixed to the coil form by bending the tab of the connection element 30 laterally as shown, tab 32 and element 30*a* being, most typically, natural extensions of connection element 30.

There has thus been shown and described a novel coil form which fulfills all the objects and advantages sought. Many changes, modifications, variations and other uses and applications of the invention will, however, become apparent to those skilled in the art after considering the specification and the accompanying drawings which disclose embodiments of the invention. All such changes, modifications, variations and other uses and applications which do not depart from the spirit and scope of the invention are deemed to be covered by the invention which is limited only by the claims which follow.

What is claimed is:

1. A winding on a coil form of insulating material comprising, a winding tube with a flange part, breakthroughs provided in the flange part, a plug-in fastening metallic connecting element in each of the breakthroughs, retaining lugs molded-on to at least two opposite edge areas of each breakthrough of the coil form being surrounded by a winding end, each lug being at least as wide as a part of the connecting element between them.

2. The winding on a coil form according to claim 1, wherein the retaining lugs are disposed on a raised surface surrounding the breakthrough.

3. The winding on a coil form according to claim 1, wherein the retaining lugs are reduced in circumference towards their free end on their end facing away from the breakthrough.

4. The winding on a coil form according to claim 1, wherein the connecting element inserted in the breakthrough being twisted between the retaining lugs.

5. The winding on a coil form according to claim 4, wherein the width of the retaining lugs corresponds to the end of the connecting element positioned crosswise due to the twisting.

6. The winding on a coil form according to claim 1, wherein the connecting element inserted between the retaining lugs is fixed by bending a tab.

* * * * *